United States Patent [19]

Truesdell

[11] 4,342,181

[45] Aug. 3, 1982

[54] FOAMED CONSTRUCTION APPARATUS AND METHOD

[76] Inventor: Deane M. Truesdell, 2958 Helber St., Flint, Mich. 48504

[21] Appl. No.: 169,963

[22] Filed: Jul. 18, 1980

[51] Int. Cl.[3] ..... E04B 1/00

[52] U.S. Cl. ..... 52/743; 52/746; 52/309.11

[58] Field of Search ..... 52/743, 746, 309.9, 52/309.11, 309.5

[56] References Cited

U.S. PATENT DOCUMENTS

| | | | |
|---|---|---|---|
| 2,234,797 | 3/1941 | Burner | 52/427 |
| 2,622,285 | 12/1952 | Roos | 52/202 |
| 3,229,441 | 1/1966 | Heffner | 52/309.11 |
| 3,302,362 | 2/1967 | Lang | 52/743 |
| 3,315,424 | 4/1967 | Smith | 52/743 |
| 3,893,275 | 7/1975 | Omholt | 52/743 |
| 4,019,296 | 4/1977 | Jochmann | 52/309.9 |
| 4,041,671 | 8/1977 | Nicholson | 52/2 |
| 4,191,001 | 3/1980 | L'Heureux | 52/743 |

FOREIGN PATENT DOCUMENTS

| | | | |
|---|---|---|---|
| 1779986 | 2/1973 | Fed. Rep. of Germany | 52/309.5 |
| 2212473 | 1/1973 | France | 52/309.5 |
| 2222505 | 10/1974 | France | 52/309.5 |
| 1134625 | 11/1968 | United Kingdom | 52/309.5 |

*Primary Examiner*—Price C. Faw, Jr.
*Assistant Examiner*—Henry E. Raduazo
*Attorney, Agent, or Firm*—Hill, Van Santen, Steadman, Chiara & Simpson

[57] ABSTRACT

Foamed construction apparatus and method wherein the walls of existing structures are used as one side of a form and a second form is attached either to the outside or the inside of the existing wall and spaced therefrom with suitable spacers and then filled with an expanding foam so as to substantially improve the insulating properties of the structure as well as to change its internal and/or external appearance. The insulating properties of the foam substantially increase the efficiency of the structure and the technique results in new and improved external and internal appearance of the structure.

4 Claims, 7 Drawing Figures

FOAMED CONSTRUCTION APPARATUS AND METHOD

BACKGROUND OF THE INVENTION

1. Filed of the Invention

This invention relates in general to energy conservation by imparting insulation and air and moisture impermeability property to existing structures and to permanently improve the appearance and wearing surfaces of the structures.

2. Description of the Prior Art

The addition of insulating materials to buildings has been known and generally has comprised filling empty wall spaces with insulation material which is blown into the walls or, alternatively, insulation has been applied by attaching sheets of the insulation material between joints or above the ceiling.

SUMMARY OF THE INVENTION

The present invention is particularly suitable for refitting of existing structures although it can be utilized in new construction of buildings. The present apparatus and system promotes essential conservation of heating-/cooling system energy and also allows diverse appearance opportunities within the cost limitations established by the insulation process. All of the components of the system have been tested and proven materials and systems are readily available which can be utilized in various applications of the invention.

The present invention provides "in situ" of continuous and monolithic insulating impermeable material which is externally or internally placed for optimum thermal and/or aesthetic and/or application opportunities onto the existing structure of a building. The membrane or layer of insulation is integrally surfaced to resist climatic fire or physical damage and also provides the desired appearance. Inherent properties of the insulation are superior thermal resistance (R=6:8 per inch), impermeability to air infiltration and moisture passage and provides added structural capabilities. The insulation of the apparatus and method may be applied to virtually any type of surface.

The primary elements of the apparatus and system are:

1. An in-place surface which may be the walls of the existing building which is termed the inner form.
2. A protective surface which is positioned and spaced to the inner form or in another manner which is approximately parallel to the inner form which creates a void between the inner and outer form.
3. A "cured-in-place" foam filler which is placed into the space between the inner and outer form so as to bond the assembly together which is designated as the foam fill.
4. Attachment and support devices which are utilized to hold the position of the outer form relative to the inner form until completion of the foam fill and bonding as occurred.
5. The addition of trim and closures so as to finish the installation.

The following definitions give general descriptions of these elements, but it is to be realized that they are not limited to the specific definitions given herein.

The inner form may comprise any in-place surface or substrate of a structure free from unprotected openings which might cause leakage of the foam fill and which are structurally adequate to resist or support application and final loads and which is clean, dry and free from deleterious contaminants which would prevent the adhesion of the foam fill. Examples are the internal or external walls of an existing building, regular or irregular surfaces containing windows and the like which might be weathered and unsightly and having inadequate thermal properties. The technique is also applicable to new structure but it would appear to have its greatest economic application to existing structures.

The outer form may be any sheet type surface which when attached in an appropriate position defines a void for foam fill between the outer form and the inner form and provides a durable protective finished surface over the foam fill. The assembly of the outer forms are so arranged to provide the desired finished appearance and are attached with spacers or bulk heads to secure and space the outer form and prevent foam leakage or deformation of the foam due to internal foaming pressures. Openings are placed in the outer form normally at the top so as to provide openings for inserting the foam between the forms.

Example of outer forms for external use might be plywood sheets, composition board or metal siding sheets which could possibly be prefinished with shiplap, lap or tongue and groove joining of abutting sheets. The outer form for internal use might be sheets of gypsum board having the required 15 minute minimum thermal barrier specification.

The foam fill could be a polyurethane frothed foam formulated to suit the particular application criteria and ambient conditions. The foam could be closed cell, inert, stable, impervious to deterioration due to solvents, insects, moisture, temperature variations or other service conditions. The foam should import structural and adhesive bonding properties adequate to resist transmitted loadings imposed on the outer form and support and retain the outer form and resist delamination of the assembly. The cured density should be approximately 1.5 to 2 pounds per cubic foot. The formulation of the foam should be useable in standard mixing-placement apparatus and adaptable in gel time and be self curing. The uncured mixture should flow easily during placement, provide expansion or blowing action to ensure complete filling of the void between the foams with low internal pressures and with wet foam surfaces so as to promote and assure adequate adhesion and bond strength.

Attachments and support devices should be compatible with the other components, be non-corrosive and of minimum cross-section or thermal conductivity. They should be adjustable to provide for irregular surfaces and have adequate strength to resist application loadings and to improve and augment the foam bond capacity.

Trim and closures should provide closure of the foaming openings, cover exposed edges and complement the outer form so as to provide a finished appearance.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
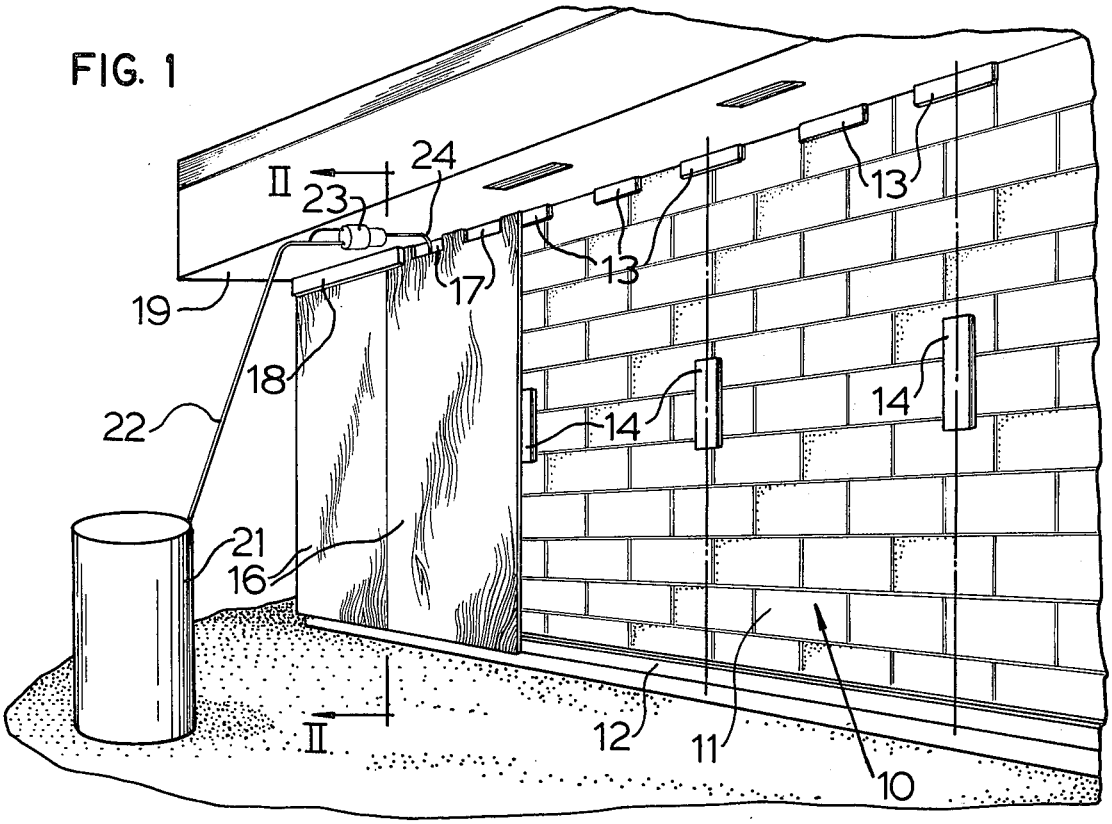
FIG. 1 is a partially cut-away sectional view illustrating the inner and outer form with spacers and foam being placed between the forms.
Figure 2:
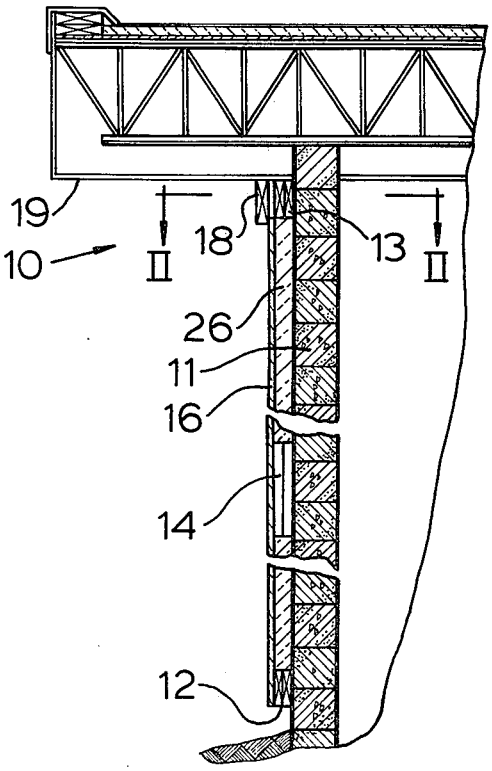
FIG. 2 is a sectional view on line II—II from FIG. 1.
Figure 3:
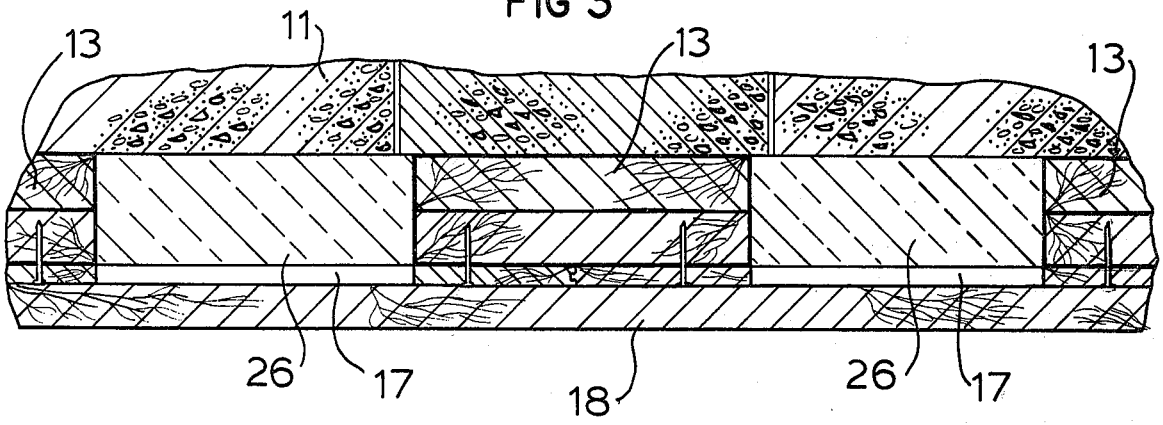
FIG. 3 is a sectional view taken on line III—III of FIG. 2.

FIGS. 1, 2 and 3 illustrate the invention as applied to the outer surface of an existing building 10 which has an outer wall 11. All contaminants and openings of the inner wall 11 are covered and cleaned to provide a supporting surface of the inner form. A first spacer block 12 is mounted adjacent the bottom of the wall 11 so as to provide spacing for the outer form. Intermediate spacers 14 are attached to the wall 11 as shown and top spacers 13 are attached to the outer wall as shown. Outer form 16 which may be of sheet material are attached to the spacers 12, 14 and 13 and are provided with openings 17 adjacent their upper end for insertion of the foam. The outer form 16 may have any desired external surface for appearance. Frothed foam is applied from a container 21 through a hose 22 and a gun 23 which has a nozzle 24 through the opening 17 to fill the void between the inner form 11 and the outer form 16 with frothed foam. After the foam has been applied, trim 18 is attached to the outer form 16 so as to cover the openings 17 adjacent the upper surface 19.

FIG. 2 is a sectional view taken on line II—II from FIG. 1 and shows the inner form 11, the outer form 16 and the spacers 12, 13 and 14.

Figure 4:
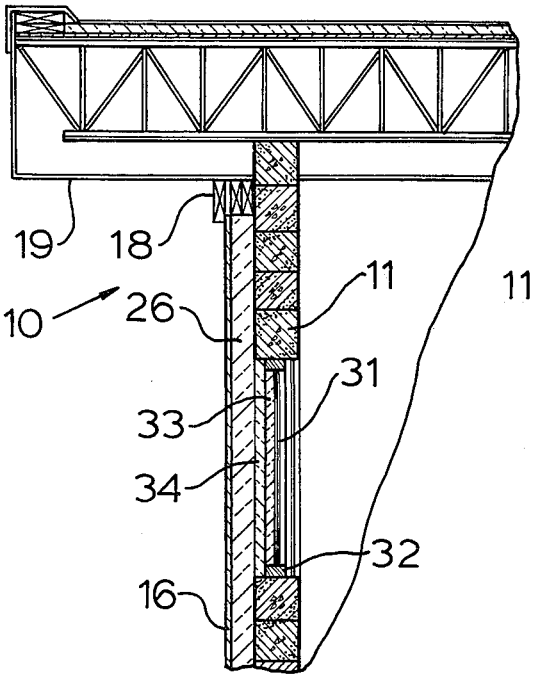
FIG. 4 is a sectional view illustrating the application of the technique over an area that includes a window.

FIG. 4 illustrates a modification of the invention wherein the wall 11 of the existing structure includes a window 31 mounted in a suitable frame 32 and in which the window 31 is to be covered by the outer form 16 and foam 26. Suitable reinforcing sheets 33 and 34 are mounted on the outer side of the window glass 31 on the side toward the foam 26 which is to be inserted so as to prevent the glass from breaking when the foam is placed between the outer and inner forms and the procedure is completed as illustrated relative to FIGS. 1 through 3 with the foam 26 being inserted between the inner and outer form so it will harden.

Figure 6:
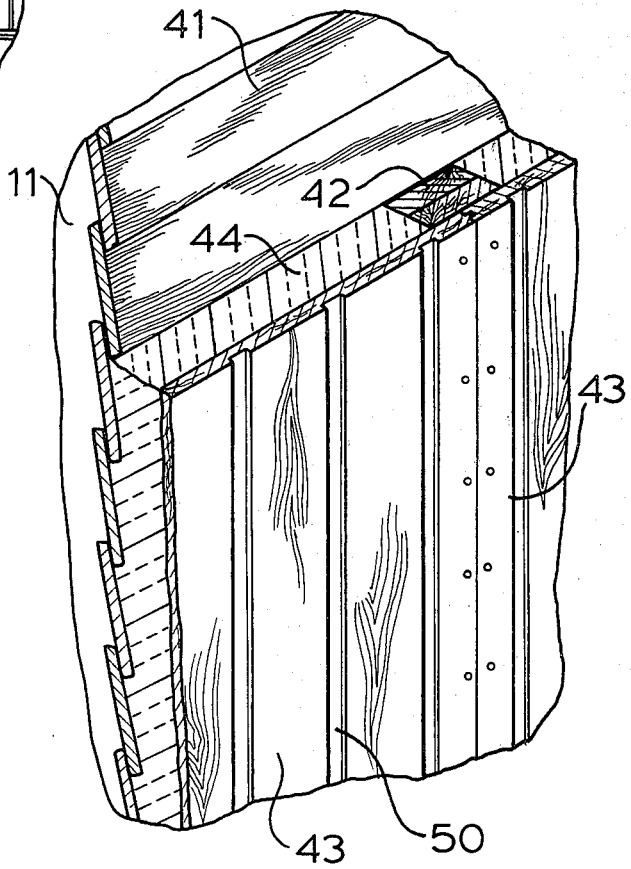
FIG. 6 illustrates a modification of the invention.

FIG. 6 illustrates a modification of the invention wherein the outer wall 11 is covered with a suitable siding 41 as, for example, lap siding and spacers 42 are attached to the wall 41 and inner form 11 and suitable outer sheets 43 are attached to the spacers 42 so as to provide the outer form. Foam 44 is applied between the inner and outer forms so as to provide the composite wall shown in sectional view in FIG. 6. It is to be noted that the outer form sheets 43 are provided with grooves 50 to provide a decorative effect.

Figure 7:
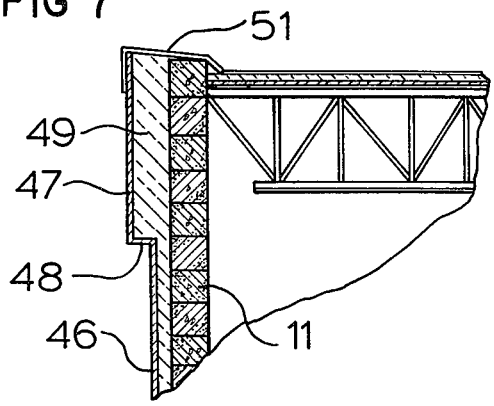
FIG. 7 illustrates another application of the invention.

FIG. 7 illustrates a further modification wherein the outer form comprises sheets 46 and 47 which are laterally offset from each other and are connected by a horizontal form member 48 so that foam 49 can be injected between the inner form 11 and the forms 46, 47 and 48 to provide the offset as illustrated. Cover flashing 51 can be attached to the top of the building to cover the foam and the top of form 47. The spacers would, of course, be utilized in the embodiment of FIG. 7 but are not illustrated in the view of FIG. 7 since such use would be obvious.

Figure 5:
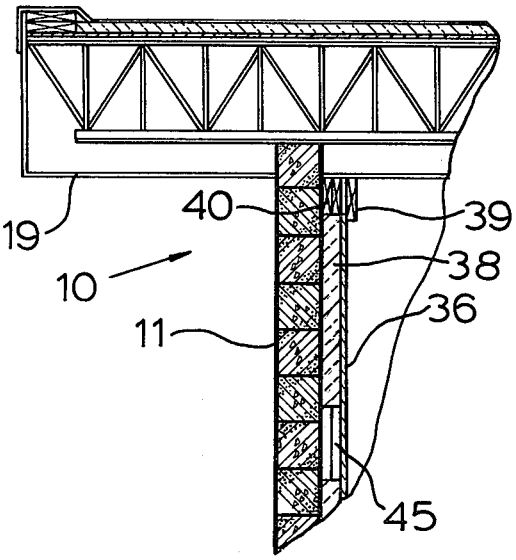
FIG. 5 illustrates a modification of the invention wherein the foam is applied to the inner wall surface of an existing structure.

FIG. 5 illustrates the invention as applied to the inside of existing wall 11. The form 36 is attached to the inside of wall 11 by spacers 40 and 45 and foam 38 is inserted between form 36 and wall 11. Trim 39 is mounted to cover the foam inserting holes.

Heat Losses: Present Structure

For a building having 2,400 sq. ft. Note: Operational losses are not included as they will not affect comparisons.

Assumptions: tl=tc=70° F., to =0° F., infiltration through masonry=6CFH reduced 40% for exterior paint and 60% for exterior/interior paint.

Attic Temperature: ta:

$$ta = \frac{UcActc + tc\,(UrAr + UwAw)}{UcAc + UrAr + UwAw} = \frac{.33 \times 2400 \times 70 + 0(.25 \times 2400 + .36 \times 700)}{.33 \times 2400 + .25 \times 2400 + .36 \times 700}$$

ta=33.7° F.

Transmission Loss Lt=Ua(tl−to).

| Item | Factor | Area/Length | (tl − to) | $Loss_t$ |
|---|---|---|---|---|
| Floor Slab Edge | .50 | 200 | | 10000 |
| Roof | .25 | 2400 | 33.7 | 20200 |
| Attic Wall | .36 | 700 | 33.7 | 8490 |
| Wall | .36 | 1550.3 | 70 | 39070 |
| Ceiling | .33 | 2400 | 36.3 | 28750 |
| Sash | 1.13 | 156 | 70 | 12340 |
| Display Window | 1.13 | 64 | 70 | 5060 |
| Door Assembly | 1.13 | 29.7 | 70 | 2350 |
| | | | | $Loss_t$ 126260 |

Infiltration Loss LI=0.018 V(tl−to).

| Item | Factor | Area/Length | (tl − to) | Constant | $Loss_I$ |
|---|---|---|---|---|---|
| Attic Wall | 3.6 | 700 | 33.7 | .018 | 1530 |
| Wall | 2.4 | 1550.3 | 70 | .018 | 4690 |
| Sash | 62 | 88 | 70 | .018 | 6870 |
| Door | 200 | 20 | 70 | .018 | 5040 |
| | | | | | $Loss_I$ = 18130 |

Combined Loss = 144390 BTU/HR

If the techniques of the invention utilizing foams and outer forms are applied to the building as shown by the Figures below:

Elevations

| Compilation of Areas/Lengths | | | | | | |
|---|---|---|---|---|---|---|
| | Perimeter | 200 | LF | | Sash | 136.5 SF |
| | Floor/Roof/Ceil Area | 2400 | SF | D | Sash (6" Foam) | 19.5 SF |
| A | Attic Wall (8" Foam) | 683 | SF | E | Display Window (16" Foam) | 64 SF |
| B | Attic Wall (12" Foam) | 12 | SF | | Door Assembly | 29.7 SF |

-continued

| Compilation of Areas/Lengths | | | | |
|---|---|---|---|---|
| | Wall (2" Foam) | 1542.3 SF | Sash Crack Length | 77 LF |
| C | Wall (12" Foam) | 8 | Door Crack Length | 0 LF |

then the heat losses of the refaced surface would be as follows:

Heat Losses: Refaced Structure

Assumptions: tl=tc=70° F., to =0° F., foam impermeable to air.

Attic Temperature: ta:

$$ta = \frac{UcAcTc = to(UrAr + Uw1Aw1 + Uw2Aw2)}{UcAc + UrAr = Uw1Aw1 + Uw2Aw2} =$$

$$\frac{.33 \times 2400 \times 70 + 0(.25 \times 2400 + .019 \times 688 + .013 \times 12)}{.33 \times 2400 + .25 \times 2400 + .019 \times 688 + .013 \times 12}$$

Transmission Loss Lt=UA(tl−to).

| Item | Factor | Area/ Length | (tl − to) | $Loss_t$ |
|---|---|---|---|---|
| Room | .25 | 2400 | 39.5 | 23700 |
| Attic Wall (8" Foam) | .019 | 688 | 39.5 | 520 |
| Attic Wall (12" Foam) | .013 | 12 | 39.5 | 6 |
| Wall (2" Foam) | .062 | 1542.3 | 70 | 6694 |
| Wall (12" Foam) | .013 | 8 | 70 | 7 |
| Sash | 1.13 | 136.5 | 70 | 20800 |
| Sash (6" Foam) | .024 | 19.5 | 70 | 33 |
| Display Window | .01 | 64 | 70 | 45 |
| Door Assembly | 1.13 | 29.7 | 70 | 2350 |
| Ceiling | .33 | 2400 | 30.5 | 24155 |
| | | | | $Loss_t$ 68310 |

Infiltration Loss LI=0.018 V(tl−to).

| Item | Factor | Area/Length | (tl − to) | Constant | $Loss_I$ |
|---|---|---|---|---|---|
| Sash | 62 | 77 | 70 | 0.018 | 6015 |
| Door | 299 | 20 | 70 | 0.018 | 5040 |
| | | | | | $Loss_I$ 11055 |

Combined Loss=79365 BTU/HR.

Net Reduction of heat loss=144390−79365=65025 BTU/HR.

This represents an improvement of 45% for the gross building envelope with only 48% of the envelope refaced. Actual improvement of the refaced areas is 90%.

Relative Effect on Cooling Load (Instantaneous sensible gain)

Assumptions: tl=78° F., to=94° F., t=2:00PM, South wall=8° F.

| | |
|---|---|
| Outside Surface (7.5MPH) | 0.25 |
| 8" LT. WT. Conc. Block | 2.00 |
| Inside surface | 0.68 |
| R = | 2.93 |
| U = 1/R = .34 | |
| Outside surface (7.5MPH) | 0.25 |
| 5/8" Plywood Facing | 0.78 |
| 2" Urethane Foam | 12.5 |
| 8" LT. WT. Conc. Block | 2.0 |
| Inside surface | 0.68 |
| R = | 16.2 |
| U = 1/R = .062 | |

$Gain_t$ = UA t
= .34 × 1 × 8 $Gain_t$ = UA t
= .062 × 1 × 8
$Gain_t$ = .49 BTU/SF/HR -continued $Gain_t$ = 2.72 BTU/SF/HR
$Gain_I$ = 0.018V(tl − to)
= 0.018 × .27 (94 − 78)
$Gain_I$ = .08 BTU/SF/HR Combined Gain=2.8 BTU/SF/HR.

Net reduction of instantaneous sensible gain: 2.8–0.49–2.3 BTU/SF/HR.

This represents an improvement of 82% for this assembly.

Similar results can be expected for other assemblies.

Conclusion

The refacing technique illustrated can be translated to other construction assemblies, with similar reductions in both heating and cooling loads.

Treatments as illustrated produce improved acoustical properties. The nature of the foam fill absorbs certain sound frequencies and consolidation of the surfaces eliminates sound transmission leaks.

Optimum placement of these systems will generally favor external surfaces as follows:

1. As the mass of the structure will be encompassed within the thermal barrier, internal temperature fluctuations will be stabilized by the heat sink effect of the structural moss. Further, sharp variations in the outdoor ambient conditions will have little effect on internal loads. These response characteristics are especially beneficial in comfort terms in structures which have essentially continuous occupancy.

2. Where structures are severely weathered resulting in masonry deterioration, cracks and jointing problems, the lamination of a new external skin serves to consolidate and cover these conditions and imports added structural strength. Thermal expansion/contraction is also minimized reducing structural working.

3. With refacing, property values are appreciated and useful life is extended.

4. External treatment obviates most code constraints.

5. External treatment is simplified, not requiring extension of mechanical-electrical devices as is occasioned with internal treatment.

6. Disruption to occupants is minimized with external treatment.

Occasions favoring internal applications are:

1. Structures with limited or sporatic occupancy where fast recovery is required from set-back temperatures will benefit from internal treatment. As the mass of the structure lies outside the thermal barrier, less energy for warm-up is required and response is faster as the mass of the structure is not heated. Thermal expansion/contraction is minimized as a result.

2. Where it is desirable to preserve external finishes, internal treatment is indicated.

Although the invention has been described with respect to preferred embodiments, it is not to be so limited as changes and modifications may be made therein which are within the full intended scope as defined by the appended claims.

I claim as my invention:

1. A method for modifying a pre-existing building comprising, securing additional side walls to the outer surfaces of the building at a number of points and on a number of surfaces so that substantially the entire additional side walls are spaced horizontally from the building on the outside thereof to form spaces between the outer surfaces of said building and the inner surfaces of said additional walls and wherein said building is formed with a door or window opening and the step of adding on the outside of said building reinforcing sheeting over said opening in said building to close said opening and substantially completely filling the spaces between such side walls and said building with an in situ foamed insulation to provide insulation without modifying the inside of said building.

2. The method of claim 1 including the additional step of cleaning the outer surface of said building before said additional walls are attached to the outer surface of said wall.

3. The method of claim 1 including the additional step of adding trim to said additional walls after said space has been filled with foamed insulation.

4. A building having superior insulation properties comprising a pre-existing building, spacer means, additional walls secured to the outside surfaces of said building by said spacer means to form spaces between said building and said additional walls including reinforcing sheets mounted on the outside surfaces of said building over a door or window opening in said pre-existing building and foamed insulation between said existing building and said additional walls so as to form layers of insulation between said outside surfaces of said building and said additional walls.

* * * * *